US005971387A

United States Patent [19]

Kita

[11] Patent Number: 5,971,387

[45] **Date of Patent: *Oct. 26, 1999**

[54] AUTOMATIC SHEET FEEDER PROVIDED IN AN IMAGE FORMING MACHINE

[75] Inventor: Nobuhiko Kita, Okazaki, Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/749,892

[22] Filed: Nov. 18, 1996

[30] Foreign Application Priority Data

Apr. 25, 1996 [JP] Japan ..... 8-105288

[51] Int. Cl.[6] ..... B65H 3/44

[52] U.S. Cl. ..... 271/9.03; 271/9.07; 271/9.12; 271/147; 271/157; 414/795.8

[58] Field of Search ..... 271/9.12, 126, 271/147, 157, 9.03, 9.07; 414/795.8

[56] References Cited

U.S. PATENT DOCUMENTS

| | | | |
|---|---|---|---|
| 5,085,421 | 2/1992 | Sellers . | |
| 5,102,112 | 4/1992 | Takahashi . | |
| 5,150,893 | 9/1992 | Uno et al. | 271/157 |
| 5,195,734 | 3/1993 | Tanabe | 271/9.03 |
| 5,221,951 | 6/1993 | Sakamoto | 271/9.12 |
| 5,335,903 | 8/1994 | Martin et al. | 271/157 |
| 5,624,108 | 4/1997 | Kubo | 271/9.12 |

FOREIGN PATENT DOCUMENTS

| | | | |
|---|---|---|---|
| 61-192636 | 8/1986 | Japan . | |
| 255328 | 11/1987 | Japan | 271/126 |
| 100184 | 4/1994 | Japan | 271/158 |

*Primary Examiner*—William E. Terrell
*Assistant Examiner*—Patrick Mackey
*Attorney, Agent, or Firm*—Burns, Doane, Swecker & Mathis, LLP

[57] ABSTRACT

An automatic sheet feeder having a first tray capable of moving upward and downward and a second tray arranged adjacently behind the first tray (upstream in a sheet feed direction). The first tray moves upward to press a first stack of sheets against a sheet feed roller. When the first stack of sheets is all fed out, the first tray moves downward, and a second stack of sheets is moved by a movement mechanism from the second tray onto the first tray. The first tray is shorter than the stack of sheets, and the second tray is longer than the stack of sheets. Even if the second stack of sheets on the second tray is displaced by vibration, the first tray can move downward without interfering with the second stack of sheets.

9 Claims, 4 Drawing Sheets

AUTOMATIC SHEET FEEDER PROVIDED IN AN IMAGE FORMING MACHINE

BACKGROUND OF THE INVENTION

1. Field of the Invention

The present invention relates to an automatic sheet feeder, and in particular, to an automatic sheet feeder for feeding stacked sheets one by one into an image forming section of a copying machine, a laser printer or the like.

2. Description of Prior Art

In recent years, sheet feeders of copying machines and printers have had increasing capacities in order to cope with copying of a large amount of sheets, and accordingly a variety of tandem stackers for mounting a sheet feed stacker with two stacks of sheets have been proposed. As shown in FIG. 4*a*, a prior art tandem stacker is made capable of moving upward and downward a first tray 101 positioned on the downstream side in a sheet feed direction P, and a stack of sheets S1 mounted on the first tray 101 are fed one by one from the uppermost one by a sheet feed roller 110. The first tray 101 moves upward according as the stack of sheets S1 reduces. On the other hand, a second tray 102 positioned on the upstream side in the sheet feed direction P is fixed in a lower position, and a stack of sheets S2 is mounted on the second tray 102. When the stack of sheets S1 is completely fed out, the first tray 101 moves downward, and a rod 103 moves in the sheet feed direction P, thereby sliding the stack of sheets S2 onto the first tray 101.

However, in the above-mentioned tandem stacker, lengths in the sheet feed direction P of the trays 101 and 102 correspond to the length of the sheets to be stacked on the trays 101 and 102. Therefore, when a vibration is applied to the sheet feeder, the stack of sheets S2 on the second tray 102 is displaced to the first tray 101 side. FIG. 4*a* shows a state in which the stack of sheets S2 is displaced by a length d. When the stack of sheets S2 is displaced as described above, a trouble occurs in moving upward and downward the first tray 101. Especially, as shown in FIG. 4*b*, the first tray 101 strands on the stack of sheets S2 when moving downward, possibly resulting in damaging the first tray 101 and its elevation mechanism.

SUMMARY OF THE INVENTION

Accordingly, it is an object of the present invention to provide a tandem stacker type automatic sheet feeder in which a stack of sheets on a second tray does not interfere with a first tray even when the stack of sheets on the second tray is displaced due to vibration.

In order to achieve the aforementioned object, the present invention provides a tandem stacker type automatic sheet feeder which has a first sheet stack tray located downstream in a sheet feed direction and a second sheet stack tray located upstream. The first tray is made capable of moving upward and downward, and the second tray is fixed in a lower position. A stack of sheets is transferred from the second tray to the first tray when the first tray is moved down. The length in the sheet feed direction of the first tray is shorter than the length in the sheet feed direction of the stacked sheets. It is preferable that the length in the sheet feed direction of the second tray is longer than the length in the sheet feed direction of the stacked sheets.

In the above structure, when the stack of sheet s on the second tray is displaced toward the first tray due to a vibration applied to the sheet feeder, the displaced stack of sheets remains stacked on the second tray and does not protrude from the second tray. It is because the second tray is set longer than the sheet length. On the other hand, since the first tray has a length shorter than the sheet length, even when the stack of sheets on the second tray is displaced toward the first tray, it can move upward and downward without interfering with the stack of sheets. Therefore, according to the present invention, the displacement of the stack of sheets on the second tray causes no trouble in moving upward and downward the first tray, thereby eliminating the risk of damage to the first tray and its elevation mechanism.

BRIEF DESCRIPTION OF THE DRAWINGS

This and other objects and features of the present invention will become apparent from the following description with reference to the accompanying drawings, in which.

DETAILED DESCRIPTION OF THE PREFERRED EMBODIMENTS

An automatic sheet feeder according to an embodiment of the present invention will be described below with reference to the accompanying drawings.

Figure 1:
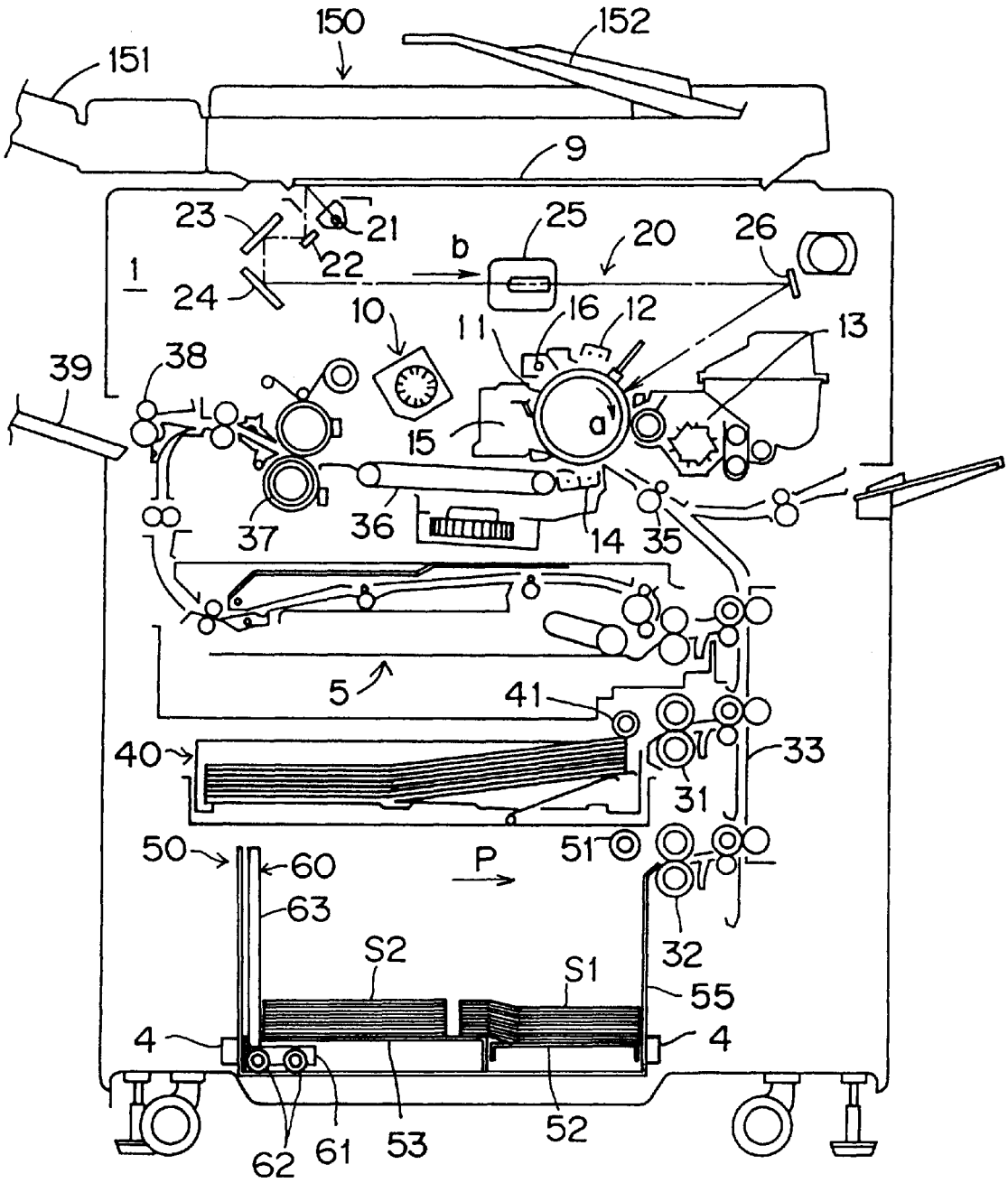
FIG. 1 is an elevational view of a copying machine showing the internal structure, the copying machine being provided with an automatic sheet feed unit which is an embodiment of the present invention.

FIG. 1 shows the internal structure of a copying machine provided with an automatic sheet feeder of the present invention.

This copying machine comprises: an image forming section 10 and a sheet re-feeding unit 5 for the purpose of duplex/composite copying, arranged in the middle position of a main body 1; an optical system 20 arranged in the upper position; an automatic sheet feed cassette 40 and a tandem stacker type automatic sheet feed unit 50, arranged in the lower position; and an automatic document feeder 150 arranged over the main body 1.

The image forming section 10 is comprised of an electrostatic charger 12, a developing unit 13, a transfer charger 14, a remaining toner cleaner 15, and a remaining electrostatic eraser lamp 16, those arranged around a photosensitive drum 11 which rotates in a direction of the arrow "a". Since an image forming process in the image forming section 10 is known, no detailed description is provided therefor.

The optical system 20 is comprised of an exposure lamp 21, movable mirrors 22, 23 and 24, a focusing lens 25 and a fixed mirror 26. The exposure lamp 21 and the movable mirror 22 integrally move at a velocity of v/m (m: magnification) relative to a peripheral velocity v of the photosensitive drum 11 in a direction of the arrow "b", and the movable mirrors 23 and 24 integrally move at a velocity of v/2m in the direction of the arrow "b", so that the image of the document set on a platen glass 9 is exposed onto the photosensitive drum 11.

The automatic document feeder 150 has a known structure in which documents are fed one by one from a tray 151 into a specified position on the platen glass 9 and stopped there, and after being subjected to exposure by the optical system 20, each document is discharged onto a tray 152.

Sheets are selectively fed one by one from either the automatic sheet feed cassette 40 or the automatic sheet feed unit 50, which will be described below, based on the rotation of a sheet feed roller 41 or 51. The fed sheets are immediately separated apart into each single sheet by a separation roller 31 or 32, fed through a vertical feed path 33 to a timing roller 35, where each sheet is adjusted for synchronization with the photosensitive drum 11 and then fed into a transfer section. After undergoing image transfer, each sheet is fed into a fixing unit 37 by way of a conveyer belt 36, subjected to toner image fixing and then discharged from a discharge roller 38 onto a tray 39.

It is to be noted that each sheet is guided downward before the discharge roller 38, fed into the sheet re-feeding unit 5, and then fed again into the transfer section in the duplex/composite copying process.

The automatic sheet feed unit 50 will be described below.

This automatic sheet feed unit 50 is approximately comprised of first and second sheet stack trays 52 and 53 placed side by side in a sheet feed direction P, an elevation mechanism 70 of the first tray 52 and a movement mechanism 60 for sliding the stack of sheets S2 on the second tray 53 onto the first tray 52. The first tray 52 moves upward according as the stack of sheets S1 reduces, so that the uppermost surface of the stack of sheets S1 is pressed against the sheet feed roller 51. The second tray 53 is fixed to a lower portion of the automatic sheet feed unit 50 and receives thereon the stack of sheets S2. When the sheets on the first tray 52 are completely fed out, the first tray 52 moves downward into the lowermost position as indicated by the solid line shown in FIG. 1. Then the movement mechanism 60 moves in the sheet feed direction P to slide the stack of sheets S2 on the second tray 53 onto the first tray 52.

The automatic sheet feed unit 50 is formed in a unit form with a housing 55 and made capable of being drawn to the front side o f the main body 1 on rails 4. Replenishing of sheets to the first and second trays 52 and 53 is performed in a state in which the unit 50 is drawn out of the main body 1.

The elevation mechanism 70 will be described next.

Figure 2:
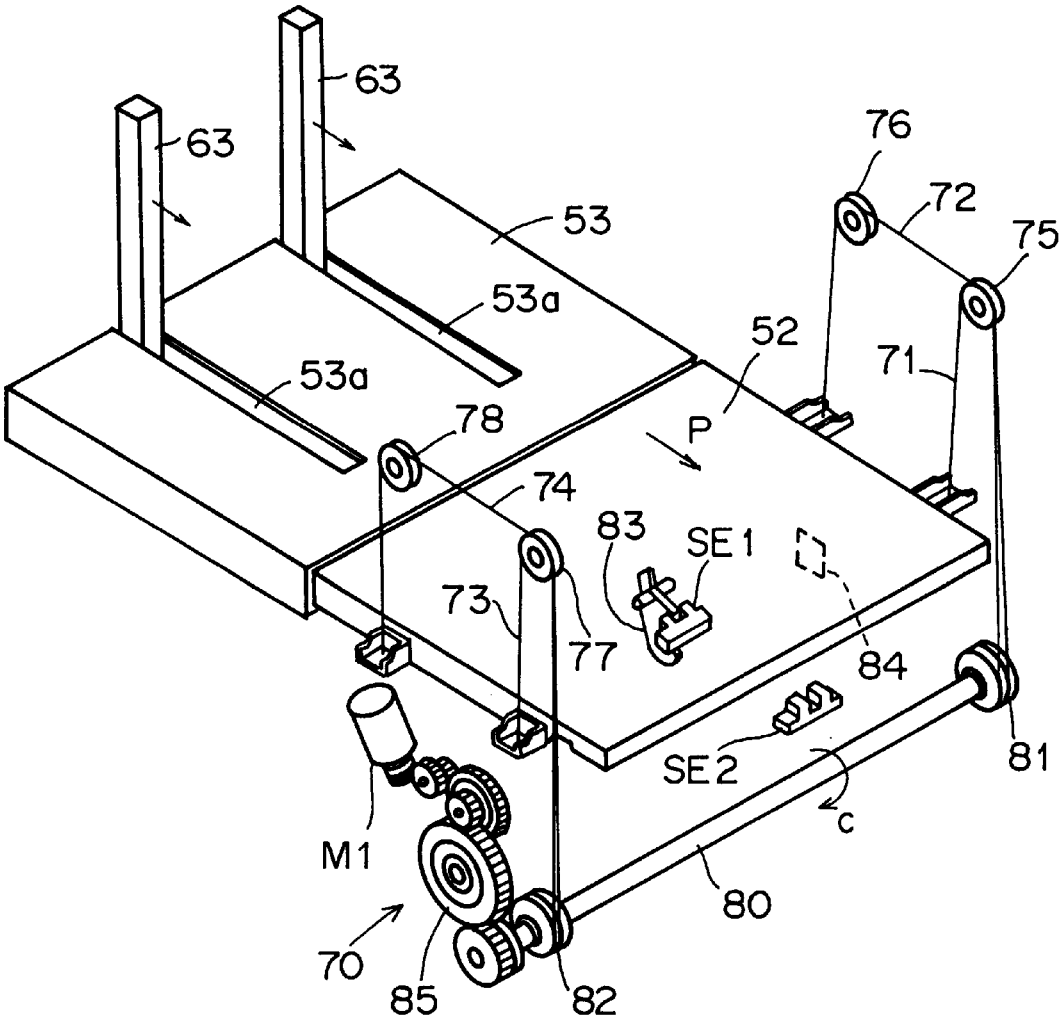
FIG. 2 is a perspective view of the automatic sheet feed unit.

In the elevation mechanism 70, as shown in FIG. 2, the first tray 52 is suspended by wires 71, 72, 73 and 74 at two portions on both sides thereof. The wires 71 and 72 are wound around a pulley 81 fixed to a shaft 80 via pulleys 75 and 76, while the wires 73 and 74 are wound around a pulley 82 fixed to the shaft 80 via pulleys 77 and 78. To the end of the shaft 80 is transmitted a rotary drive force from a reversible lift-up motor M1 via a reduction mechanism 85. The wires 71 through 74 are wound around the pulleys 81 and 82 by the rotation (in a direction indicated by the arrow "c" in FIG. 2) of the shaft 80 according to the forward rotation of the motor M1, so that the first tray 52 moves upward. On the other hand, the wires 71 through 74 are rewound from the pulleys 81 and 82 by the rotation (in a direction reverse to the direction of the arrow "c") of the shaft 80 according to the reverse rotation of the motor M1, so that the first tray 52 moves downward.

Just above the first tray 52 are placed an upper level sensor SE1 and a light shield plate 83 which can retreat from the optical axis of the sensor SE1. The swingable light shield plate 83 is pushed up by the stack of sheets S1 on the first tray 52, so that the optical axis of the upper level sensor SE1 is interrupted. In this moment, the forward rotation of the motor M1 is turned off by an on-signal out-putted from the sensor SE1, so that the upward movement of the first tray 52 is stopped. On the other hand, just below the first tray 52 are placed a light shield plate 84 provided on the back surface of the first tray 52 and a lower level sensor SE2 which can retreat from the optical axis of the sensor SE2. When the first tray 52 moves downward and the light shield plate 84 interrupts the optical axis of the lower level sensor SE2, the sensor SE2 is turned on. The reverse rotation of the motor M1 is turned off by this on-signal, so that the downward movement of the first tray 52 is stopped.

The movement mechanism 60 will be described next.

The movement mechanism 60 is constructed by providing two rods 63 protrudingly on a cart 61 having rollers 62. The cart 61 can move in the sheet feed direction P and in the direction reverse thereto by forwardly and reversely driving a motor (not shown). The second tray 53 is provided with slits 53*a*, and the rods 63 move in the sheet feed direction P together with the cart 61 along the slits 53*a* by the forward rotation of the motor. With the movement of the rods 63 in the sheet feed direction P, the stack of sheets S2 slides from the second tray 53 onto the first tray 52.

Figure 3A:
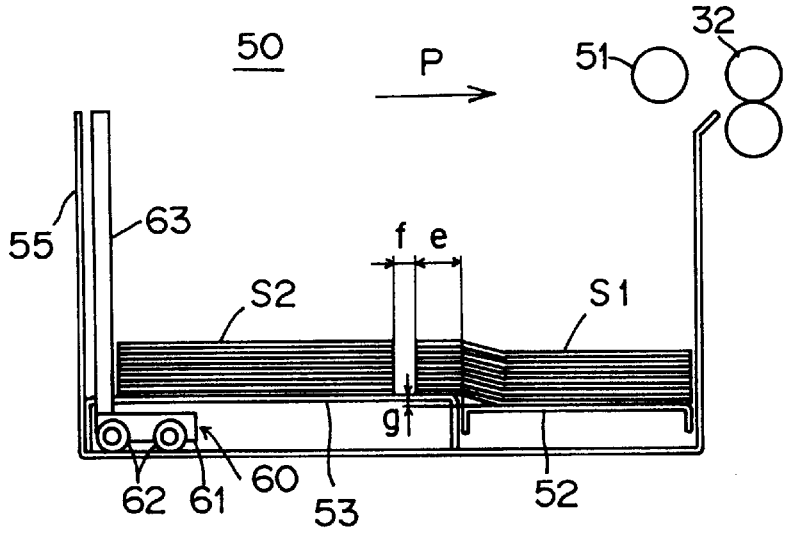
FIGS. 3*a*, 3*b* and 3*c* are views for explaining the operation of the automatic sheet feed unit.
Figure 3B:
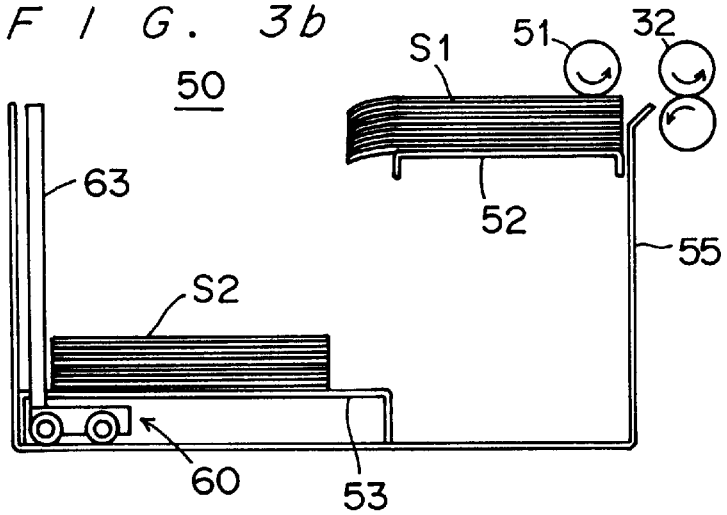
Figure 3C:
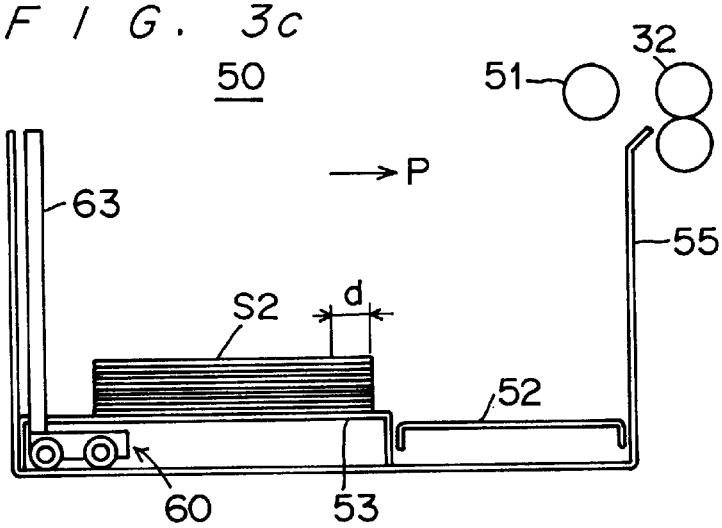
Figure 4A:
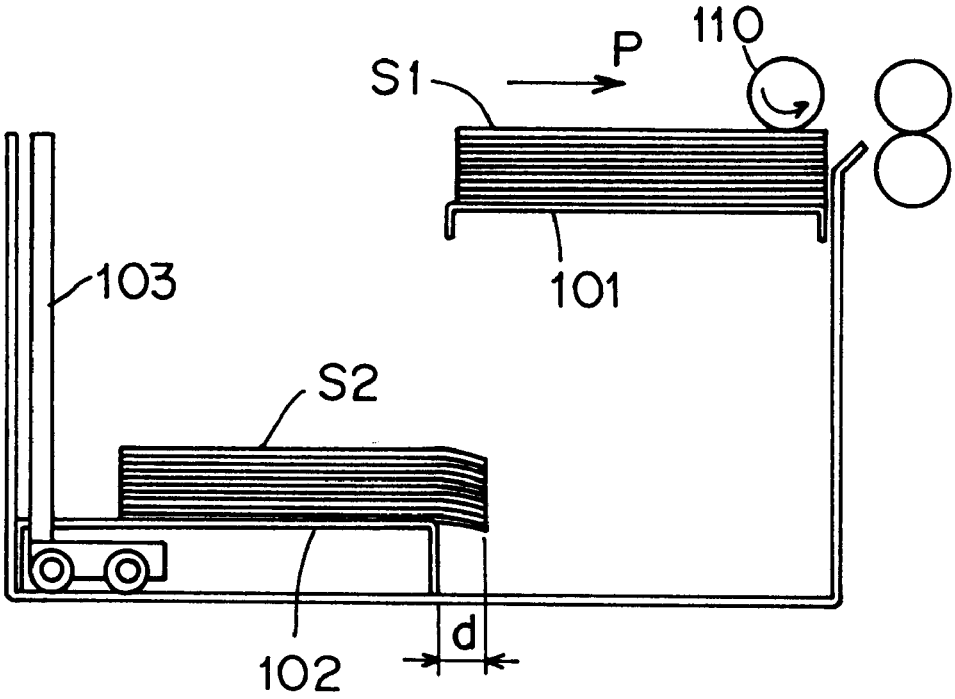
FIG. 4a PRIOR ART
FIGS. 4*a* and 4*b* are views for explaining the operation of a prior art automatic sheet feed unit.
Figure 4B:
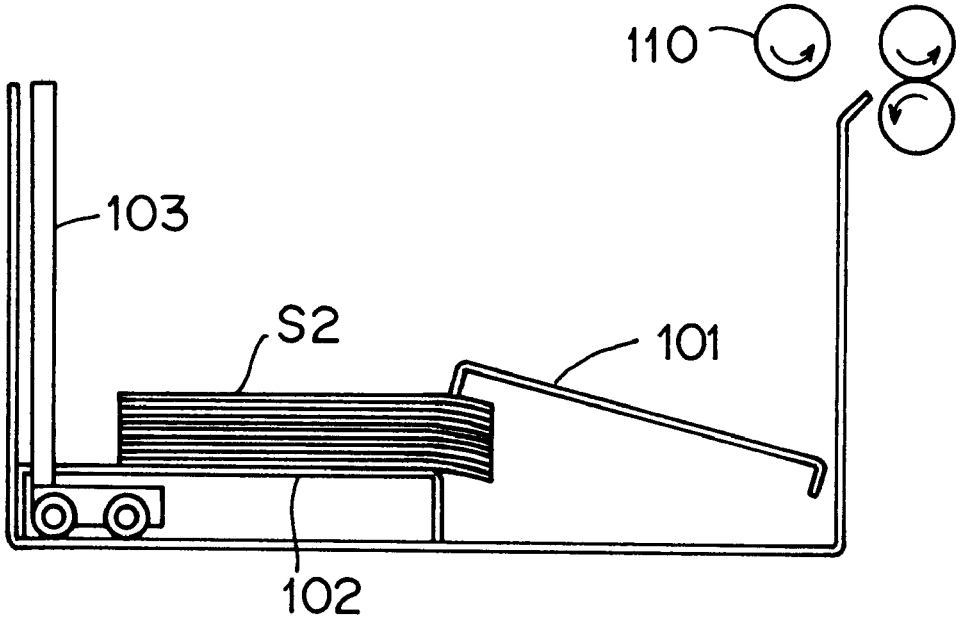
FIG. 4b PRIOR ART

In the automatic sheet feed unit 50, the length in the sheet feed direction of the first tray 52 is set shorter than the length in the sheet feed direction of the sheets, and the length in the sheet feed direction of the second tray 53 is set longer than the length in the sheet feed direction of the sheets. In detail, as shown in FIG. 3*a*, the trailing end of the first tray 52 is located on the downstream side in the sheet feed direction P by a dimension "e" with respect to the trailing end of the sheet. The stack of sheets S2 is placed on the second tray 53 with a clearance of a dimension "f"with respect to the trailing end of the stack of sheets S1 on the first tray 52. If the stack of sheets S2 is displaced by a dimension "d" in the sheet feed direction P (refer to FIG. 3*c*) due to vibration when the first tray 52 is moving upward (refer to FIG. 3*b*), the first tray 52 can move downward to the lower limit position without interfering with the stack of sheets S2, so that the stack of sheets S2 can move onto the first tray 52 without any trouble.

The aforementioned dimensions "e" and "f" are determined by the sheet size and a maximum estimated amount of displacement of the stack of sheets S2. For example, in the case where the sheets are of an A4 size and are placed side-wise (the shorter sides of the sheets are placed in parallel with the sheet feed direction P), it is preferable to set the dimension "e" at 15 mm and set the dimension "f" at 8 mm. In general, it is appropriate to set the dimension "e" at 3 to 30 mm for a variety of sheet sizes.

Furthermore, in the automatic sheet feed unit 50, the lower limit position of the first tray 52 is set lower by a dimension "g" than the level of the second tray 53. Concretely in the present embodiment, the first tray 52 is placed lower by 3 mm than the second tray 53. This arrangement is to smoothly move the stack of sheets S2 onto the first tray 52.

Although the present invention has been described in connection with the preferred embodiment, it is to be noted that various changes and modifications are possible to those who are skilled in the art. Such changes and modifications are to be understood as being within the scope of the present invention.

In particular, the structures of the elevation mechanism 70 and the movement mechanism 60 are arbitrary.

What is claimed is:

1. An automatic sheet feeder for feeding a stack of sheets one by one in a direction, comprising:

a first sheet stack tray which moves upward and downward between an upper position and a lower position and is located downstream in a sheet feed direction;

sheet feed means for feeding sheets on the first sheet stack tray one by one;

a second sheet stack tray which is located upstream in the sheet feed direction and is arranged adjacent to said first sheet stack tray, an entire sheet receiving surface of the first sheet stack tray in the upper position being above a sheet receiving surface of the second sheet stack tray; and sheet stack moving means for sliding a stack of sheets from said second sheet stack tray onto said first sheet stack tray when all the sheets stacked on the first sheet stack tray are fed out and the first sheet stack tray is moved down, wherein a length in the sheet feed direction of said first sheet stack tray is shorter than a length in the sheet feed direction of the stack of sheets, and a length in the sheet feed direction of said second sheet stack tray is longer than a length in the sheet feed direction of the stack of sheets.

2. An automatic sheet feeder as claimed in claim 1, wherein the sheet receiving surface of said first sheet stack tray is on a lower level than the sheet receiving surface of said second sheet stack tray when the stack of sheets is slid from the second sheet stack tray to the first sheet stack tray.

3. An automatic sheet feeder for feeding a stack of sheets one by one in a direction, comprising:

a first sheet stack tray which moves upward and downward between an upper position and a lower position and is located downstream in a sheet feed direction;

a sheet feed roller for feeding sheets on the first sheet stack tray one by one;

a second sheet stack tray which is located upstream in the sheet feed direction and is arranged adjacent to said first sheet stack tray, an entire sheet receiving surface of the first sheet stack tray in the upper position being above a sheet receiving surface of the second sheet stack tray; and a rod for sliding a stack of sheets from said second sheet stack tray onto said first sheet stack tray when all the sheets stacked on the first sheet stack tray are fed out and the first sheet stack tray is moved down, wherein a length in the sheet feed direction of said first sheet stack tray is shorter than a length in the sheet feed direction of the stack of sheets, and a length in the sheet feed direction of said second sheet stack tray is longer than a length in the sheet feed direction of the stack of sheets.

4. An automatic sheet feeder as claimed in claim 3, wherein the sheet receiving surface of said first sheet stack tray is on a lower level than the sheet receiving surface of said second sheet stack tray when the stack of sheets is slid from the second sheet stack tray to the first sheet stack tray.

5. A sheet feeding method comprising steps of:

storing a first sheet stack on a first sheet receiving surface having a length in a sheet feeding direction which is shorter than a length of a sheet of the first sheet stack;

storing a second sheet stack on a second sheet receiving surface having a length in the sheet feeding direction which is longer than a length of a sheet of the second sheet stack;

moving the entire first sheet receiving surface storing the first sheet stack upward to a sheet feed rotator to position the entire first sheet receiving surface above the second sheet receiving surface;

feeding sheets of the first sheet stack stored on the first sheet receiving surface one by one by said sheet feed rotator;

moving the first sheet receiving surface down to a predetermined position which is positioned at lower level than said second sheet receiving surface when all the sheets of the first sheet stack on the first sheet receiving surface are fed by said sheet feed rotator in said feeding step;

sliding the second sheet stack from the second sheet receiving surface onto the first sheet receiving surface positioned at said predetermined position;

moving the entire first sheet receiving surface storing the second sheet stack upward from said predetermined position to the sheet feed rotator; and feeding sheets of the second sheet stack stored on the first sheet receiving surface one by one by said sheet feed rotator.

6. An automatic sheet feeder as claimed in claim 1, further comprising an elevation mechanism for moving the first sheet stack tray between the upper position and the lower position.

7. An automatic sheet feeder as claimed in claim 6, wherein the elevation mechanism moves the first sheet stack vertically without rotation.

8. An automatic sheet feeder as claimed in claim 3, further comprising an elevation mechanism for moving the first sheet stack tray between the upper position and the lower position.

9. An automatic sheet feeder as in claim 8, wherein the elevation mechanism moves the first sheet stack vertically without rotation.

* * * * *